US006918826B2

(12) United States Patent
Nakajima et al.

(10) Patent No.: US 6,918,826 B2
(45) Date of Patent: Jul. 19, 2005

(54) COIN TREATING DEVICE

(75) Inventors: Kenji Nakajima, Iruma-gun (JP); Yasuyuki Kodama, Sakado (JP); Takahiro Hayashi, Sakado (JP); Masato Yagi, Sakado (JP); Shinichi Kosugi, Sakado (JP); Takeshi Ishida, Sakado (JP); Tsunehiro Aso, Sakado (JP); Kenji Koyama, Sakado (JP)

(73) Assignee: Kabushiki Kaisha Nippon Conlux, Tokyo (JP)

( * ) Notice: Subject to any disclaimer, the term of this patent is extended or adjusted under 35 U.S.C. 154(b) by 58 days.

(21) Appl. No.: 10/111,056

(22) PCT Filed: Jul. 9, 2001

(86) PCT No.: PCT/JP01/05956

§ 371 (c)(1),
(2), (4) Date: Apr. 17, 2002

(87) PCT Pub. No.: WO02/17245

PCT Pub. Date: Feb. 28, 2002

(65) Prior Publication Data

US 2002/0168931 A1 Nov. 14, 2002

(30) Foreign Application Priority Data

Aug. 23, 2000 (JP) ..... 2000-252435
Sep. 1, 2000 (JP) ..... 2000-265406
Sep. 7, 2000 (JP) ..... 2000-271673

(51) Int. Cl.[7] ..... G07F 9/10
(52) U.S. Cl. ..... 453/3; 194/350; 70/78
(58) Field of Search ..... 453/3, 1, 2, 63, 453/18; 194/215, 216, 350; 70/1, 57, 77, 78, 79, 81, 262, 263, DIG. 38, DIG. 40, DIG. 73

(56) References Cited

U.S. PATENT DOCUMENTS

| | | | | | |
|---|---|---|---|---|---|
| 1,879,350 | A | * | 9/1932 | Leeb | 70/150 |
| 3,782,139 | A | * | 1/1974 | Rubner | 70/81 |
| 5,181,882 | A | * | 1/1993 | Miyazawa | 453/63 |
| 5,997,396 | A | * | 12/1999 | Itako | 453/17 |
| 6,173,594 | B1 | * | 1/2001 | Majima | 70/79 |
| 6,264,546 | B1 | * | 7/2001 | Iida et al. | 453/17 |

FOREIGN PATENT DOCUMENTS

| | | | | |
|---|---|---|---|---|
| JP | 57-179770 | | 11/1982 | |
| JP | 60-211593 | A * | 10/1985 | G07D/1/04 |
| JP | 61-059592 | A * | 3/1986 | G07D/9/00 |
| JP | 62-27944 | A * | 7/1987 | G07D/1/00 |
| JP | 62-27944 | | 7/1987 | |
| JP | 63-282596 | A * | 11/1988 | G07F/5/22 |
| JP | 5-174222 | A * | 7/1993 | G07D/1/00 |
| JP | 06-346906 | A | 12/1994 | |
| JP | 07-114659 | A | 5/1995 | |
| JP | 11-339102 | A | 12/1999 | |

* cited by examiner

*Primary Examiner*—Donald P. Walsh
*Assistant Examiner*—Mark J. Beauchaine
(74) *Attorney, Agent, or Firm*—Welsh & Katz, Ltd.

(57) ABSTRACT

A coin treating device, wherein a key cylinder type locking means for limiting the release of the latch of the latch means is disposed in a coin storage unit so that the coin storage unit cannot easily be removed from a device main body other than in some specific cases.

8 Claims, 11 Drawing Sheets

COIN TREATING DEVICE

TECHNICAL FIELD

The present invention relates to a coin treating device that sorts and stores inserted coins by denomination and pays out sorted and stored coins as change, and is used in a vending machine, a money changer, a service apparatus or the like.

BACKGROUND ART

Conventionally, coin treating devices that sort and store inserted coins by denomination and pay out sorted and stored coins as change have been installed in vending machines, money changers, service apparatuses and the like.

Broadly speaking, such a coin treating device comprises the following 4 components.

(1) A device main body that constitutes the housing of the coin treating device.

(2) A coin sorting unit that is provided in an uppermost part of the device main body, and sorts inserted coins into genuine and counterfeit coins and sorts the genuine coins by denomination.

(3) A coin storage unit that is provided in the device main body positioned below the coin sorting unit, and comprises a plurality of coin tubes in which genuine coins that have been sorted by denomination by the coin sorting unit are accumulated and stored by denomination.

(4) A coin payout unit that is provided in the device main body positioned below the coin storage unit, and pays out genuine coins stored in the coin storage unit as change.

Moreover, of the above constituent components, the coin storage unit in particular, which comprises the plurality of coin tubes, is installed detachably in the device main body, so that maintenance/inspection work including the replenishing of change can be carried out easily.

Moreover, latch means lies between the device main body and the coin storage unit, with the constitution being such that the coin storage unit is prevented from falling out from the device main body by the latch means during normal use.

When carrying out maintenance/inspection work such as replenishing change, anyone can easily release the latch between the device main body and the coin storage unit by operating the latch means, and remove the coin storage unit from the device main body.

Moreover, the coin treating device has provided therein inventory means for paying out coins from each of the coin tubes in order to carry out forcible collection of coins stored in the coin storage unit, i.e. to carry out inventory processing.

This inventory means comprises various types of switch such as a plurality of inventory switches for paying out the coins stored in each of the coin tubes independently and an automatic change adjusting switch for carrying out automatic adjustment of the number of coins stored in each of the coin tubes, along with pilot lamps and the like.

By pushing each of the inventory switches of the inventory means, inventory processing is carried out in which coins are forcibly paid out from the corresponding coin tube of the coin storage unit via the coin payout unit.

However, with the conventional coin treating device described above, the latch means for preventing the coin storage unit from falling out of the device main body is constituted such that anyone can easily release the latch through a simple operation and remove the coin storage unit from the device main body. Thus, when the coin treating device is exposed to the outside during maintenance/inspection work of a vending machine, a money changer, a service apparatus or the like as mentioned above, there is a risk that that somebody could release the latch using the latch means and take the coin storage unit away from the device main body.

Moreover, with the conventional coin treating device described above, the switches of the inventory means are always operable, and hence if during maintenance/inspection work of a vending machine, a money changer, a service apparatus or the like as mentioned above, the coin treating device is exposed to the outside, then there is a risk that that somebody could operate the inventory switches of the inventory means without permission, in which case the inventory processing would be carried out and coins would be paid out from the coin storage unit and could then be taken away.

DISCLOSURE OF THE INVENTION

It is an object of the present invention to provide a coin treating device for which stealing of coins is prevented as much as possible.

To attain the above object, with a first aspect of the present application, in a coin treating device in which a coin storage unit is installed detachably in a device main body via latch means, key cylinder type locking means that restricts release of latching by the latch means is provided in the coin storage unit.

Further, with a second aspect of the present application, in a coin treating device including inventory means that carries out inventory processing of forcibly paying out coins from a coin storage unit, a control apparatus is provided that forbids the inventory processing by the inventory means at normal times, and permits the inventory processing by the inventory means when the coin storage unit is detached and then re-installed.

Furthermore, with a third aspect of the present application, in a coin treating device including inventory means that carries out inventory processing of forcibly paying out coins from a coin storage unit, a control apparatus is provided that forbids and lifts forbiddance of the inventory processing based on detachment and re-installment of the coin storage unit together with specified operation by the inventory means.

BEST MODE FOR CARRYING OUT THE INVENTION

Following is a detailed description of an embodiment of the coin treating device according to the present invention.

Figure 1:
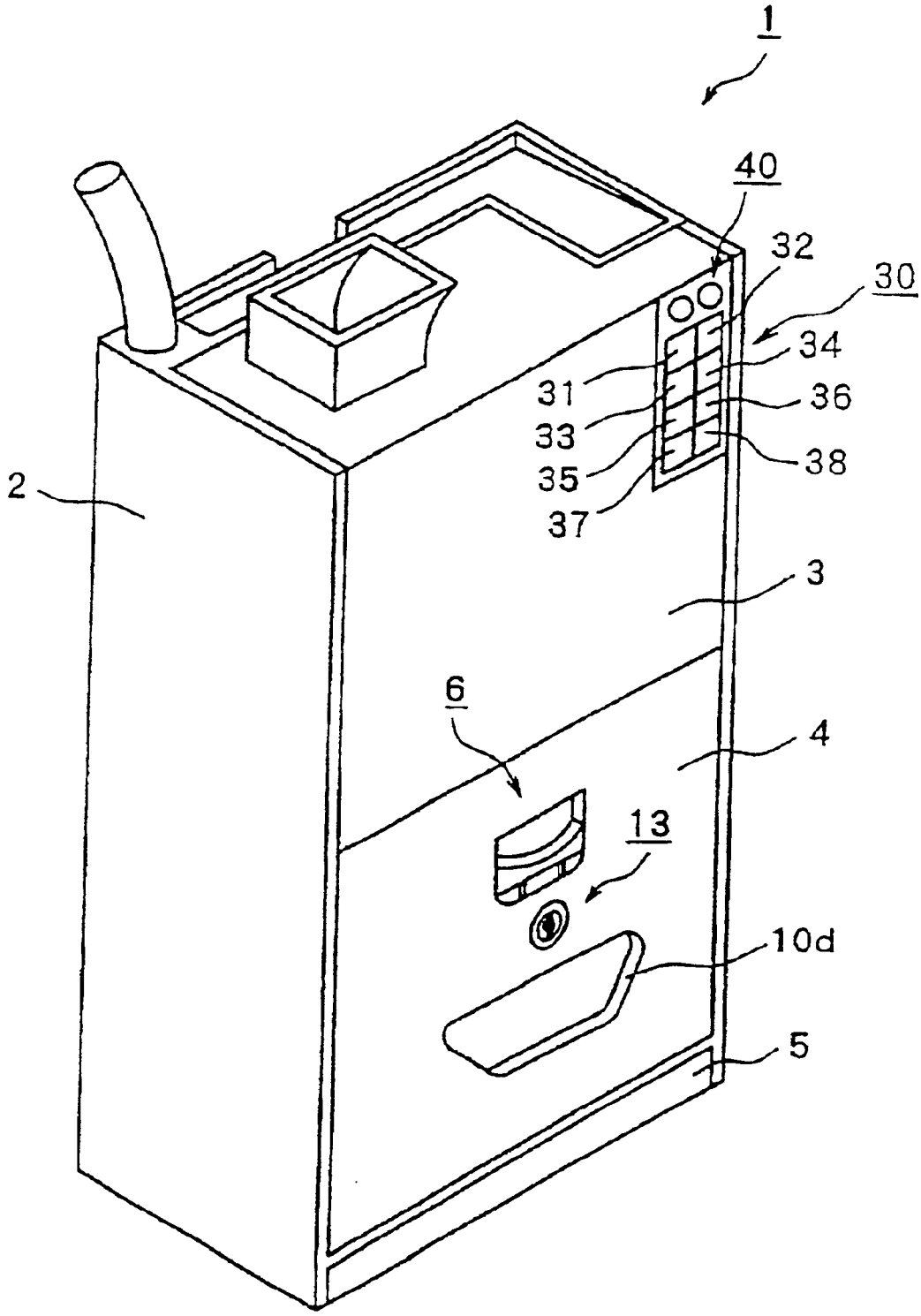
FIG. 1 is a schematic perspective view of a coin treating device according to a first embodiment.

FIG. 1 is a schematic perspective view of the coin treating device 1 according to the embodiment.

As in conventional devices, this coin treating device 1 is broadly speaking constituted from the following 4 components.

A device main body 2 that has a U-shaped cross section and constitutes the housing of the coin treating device 1;

A coin sorting unit 3 that is provided detachably in an uppermost part of the device main body 2, and sorts inserted coins into genuine and counterfeit coins and sorts the genuine coins by denomination;

A coin storage unit 4 that is provided in the device main body 2 positioned below the coin sorting unit 3, and comprises a plurality of coin tubes in which genuine coins that have been sorted by denomination by the coin sorting unit 3 are accumulated and stored by denomination; and A coin payout unit 5 that is provided in the device main body 2 positioned below the coin storage unit 4, and pays out genuine coins stored in the coin storage unit 4 as change.

Moreover, of the above constituent components, the coin storage unit 4 in particular, which comprises the plurality of coin tubes, is installed detachably in the device main body 2 via latch means 6, so that maintenance/inspection work such as replenishing change can be carried out easily.

Figure 2:
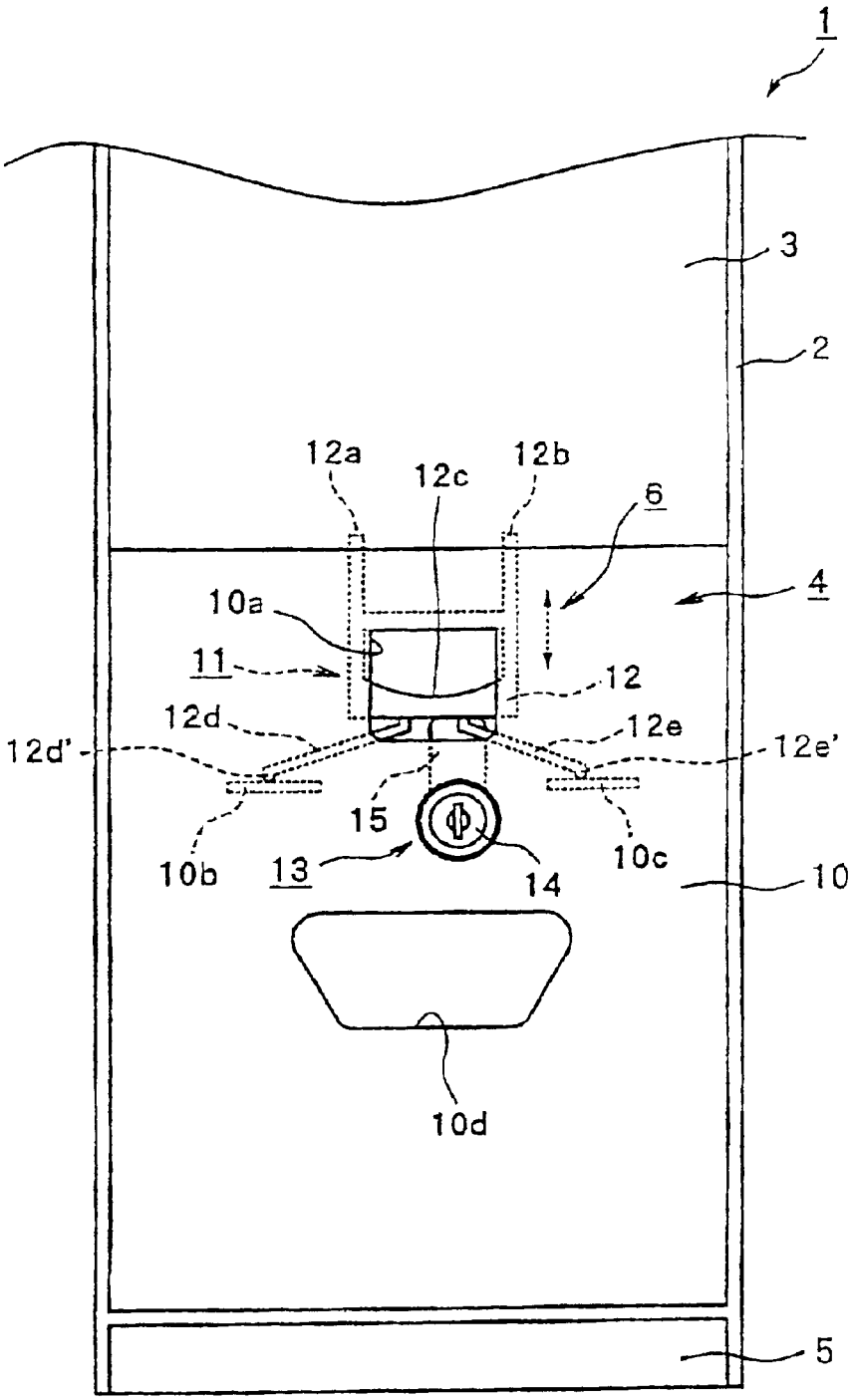
FIG. 2 is an enlarged front view of main parts in FIG. 1.

As shown in FIG. 2, which is an enlarged front view of FIG. 1, the latch means 6 comprises a latch lever 11 that is provided so as to be slidable in the up/down direction between a front panel 10 and a rear panel (described later) of the coin storage unit 4.

The latch lever 11 comprises a frame 12 that is rectangular viewed from the front and has formed at the top thereof a pair of projections 12*a* and 12*b*; at the bottom of the frame 12, a curved finger grip 12*c* for operation by an operator is formed and this finger grip 12*c* is exposed from a rectangular operator operation hole 10*a* provided in the front panel 10.

In FIG. 2, the pair of projections 12*a* and 12*b* of the frame 12 are inserted into engagement holes (not shown) that are formed in a lower end of the coin sorting unit 3, and the coin storage unit 4 is latched into the device main body 2 via the coin sorting unit 3.

Moreover, a pair of elastic tongue pieces 12*d* and 12*e* are provided integrally with the frame 12 that constitutes the latch lever 11 so as to project out from a lower end of the frame 12 in a reversed V-like shape, and the respective tips 12*d*' and 12*e*' thereof slidably contact upper surfaces of a pair of corresponding ribs 10*b* and 10*c* formed on a rear face of the front panel 10.

Moreover, a finger grip recess 10*d* used when an operator operates the latch lever 11 is formed in the front panel 10 positioned below the rectangular operator operation hole 10*a*.

Further, key cylinder type locking means 13 that restricts the release of the latch of the coin storage unit 4 by the latch means 6 is provided in the front panel 10 between the operator operation hole 10*a* and the finger grip recess 10*d*.

The key cylinder type locking means 13 comprises a key cylinder 14 that turns through key operation described later, and a rectangular stopper piece 15 that is fixed to a tip of the key cylinder 14 and turns with the key cylinder 14.

According to such a key cylinder type locking means 13, in the initial position shown in FIG. 2, the stopper piece 15 of the key cylinder type locking means 13 is in contact with a lower end of the finger grip 12*c* of the latch lever 11, and hence the downwards movement of the latch lever 11 is stopped, and thus the release of the latch of the coin storage unit 4 using the latch means 6 is restricted.

Consequently, in the initial position of the key cylinder type locking means 13 shown in FIG. 2, the stopper piece 15 abuts against the lower end of the finger grip 12*c* of the latch lever 11, stopping the downwards movement of the latch lever 11, and hence even if an operator or whoever not having a key tries to move the latch lever 11 downwards via the finger grip 12*c* of the latch lever 11 in order to release the latch of the coin storage unit 4 using the latch means 6, the latch lever 11 will not move downwards, and hence engagement (latching) between the pair of projections 12*a* and 12*b* of the frame 12 and the coin sorting unit 3 will be maintained as before. Thus, the coin storage unit 4 cannot be removed and taken away from the device main body 2 at will by somebody who does not have a key.

Figure 3:
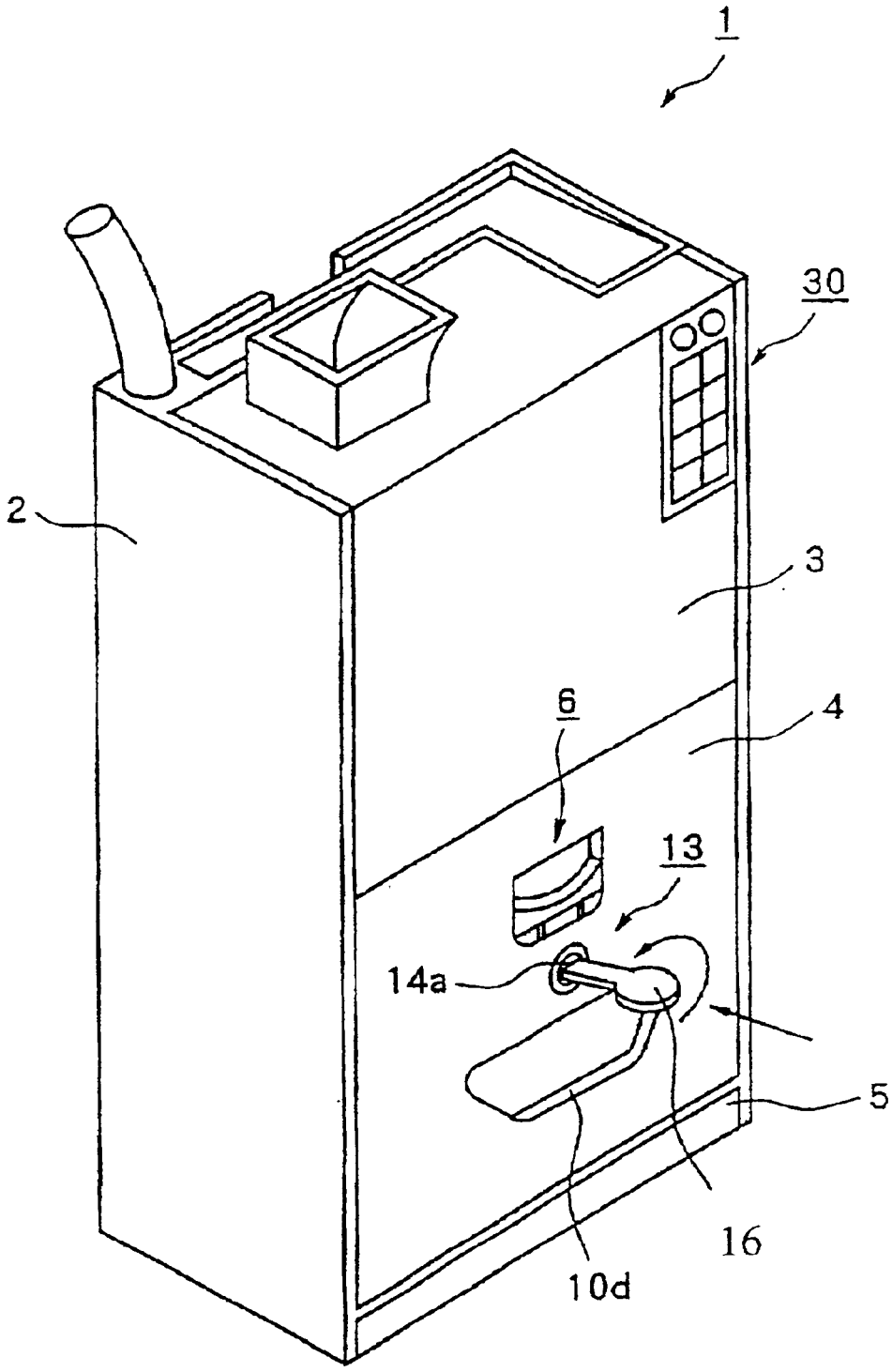
FIG. 3 is a schematic perspective view showing operation of the coin treating device according to the first embodiment.

On the other hand, to release the latch of the coin storage unit 4 using the latch lever 11 and remove the coin storage unit 4, as shown in FIG. 3, in which parts the same as in FIG. 1 are represented by the same reference numerals, an operator having a key 16 first inserts the key into a keyhole 14*a* of the key cylinder type locking means 13, and then turns the key 16 in a counterclockwise direction as shown by the arrow.

Figure 4:
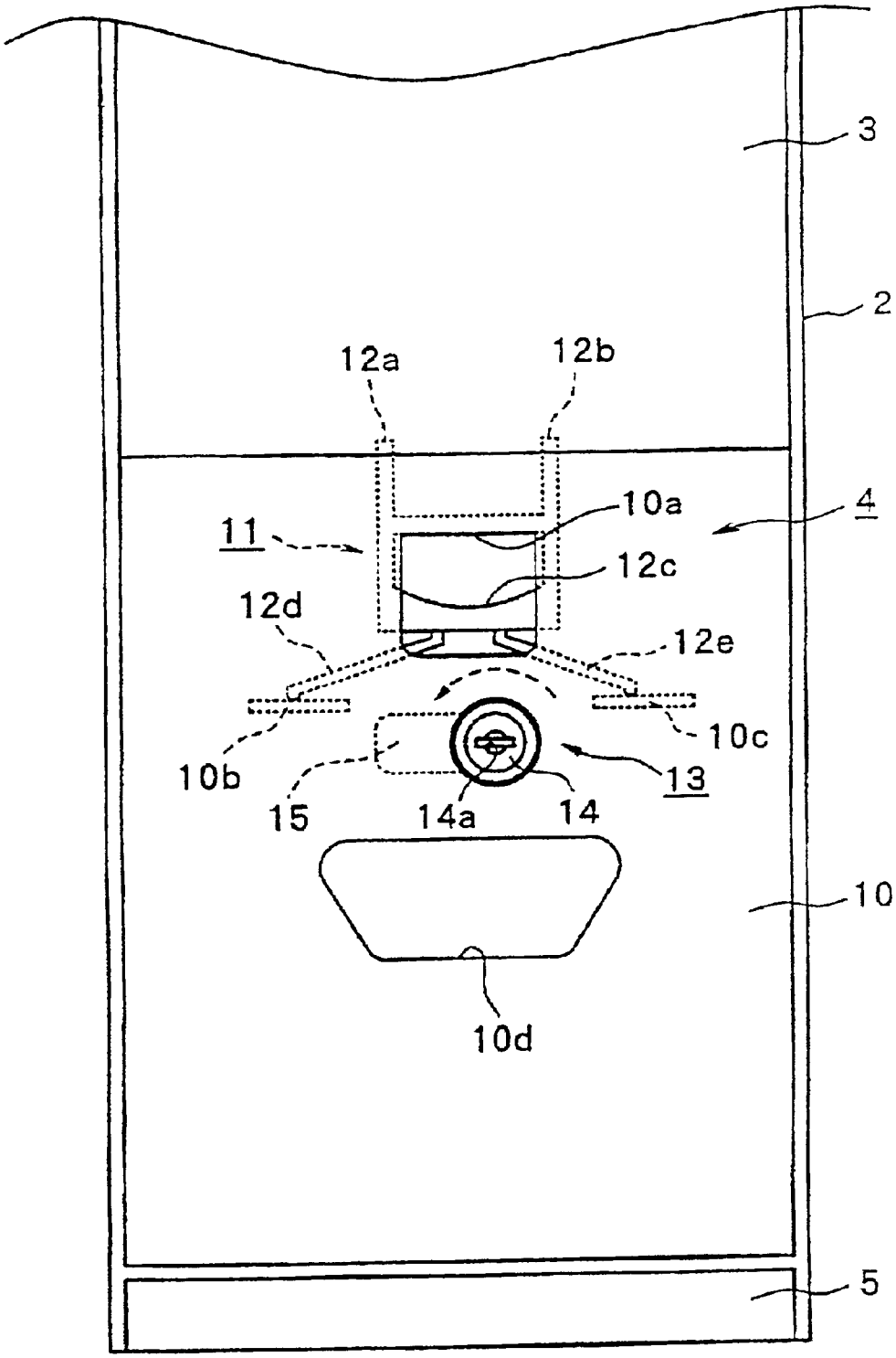
FIG. 4 is an enlarged front view of main parts in FIG. 3.

As shown in FIG. 4, which is an enlarged front view of FIG. 3 (note that the key 16 is omitted from FIG. 4), the stopper piece 15 of the key cylinder type locking means 13 thus turns in the counterclockwise direction with the turning of the key 16 (FIG. 3), and hence the contact between the stopper piece 15 and the finger grip 12*c* of the latch lever 11 is released.

Figure 5:
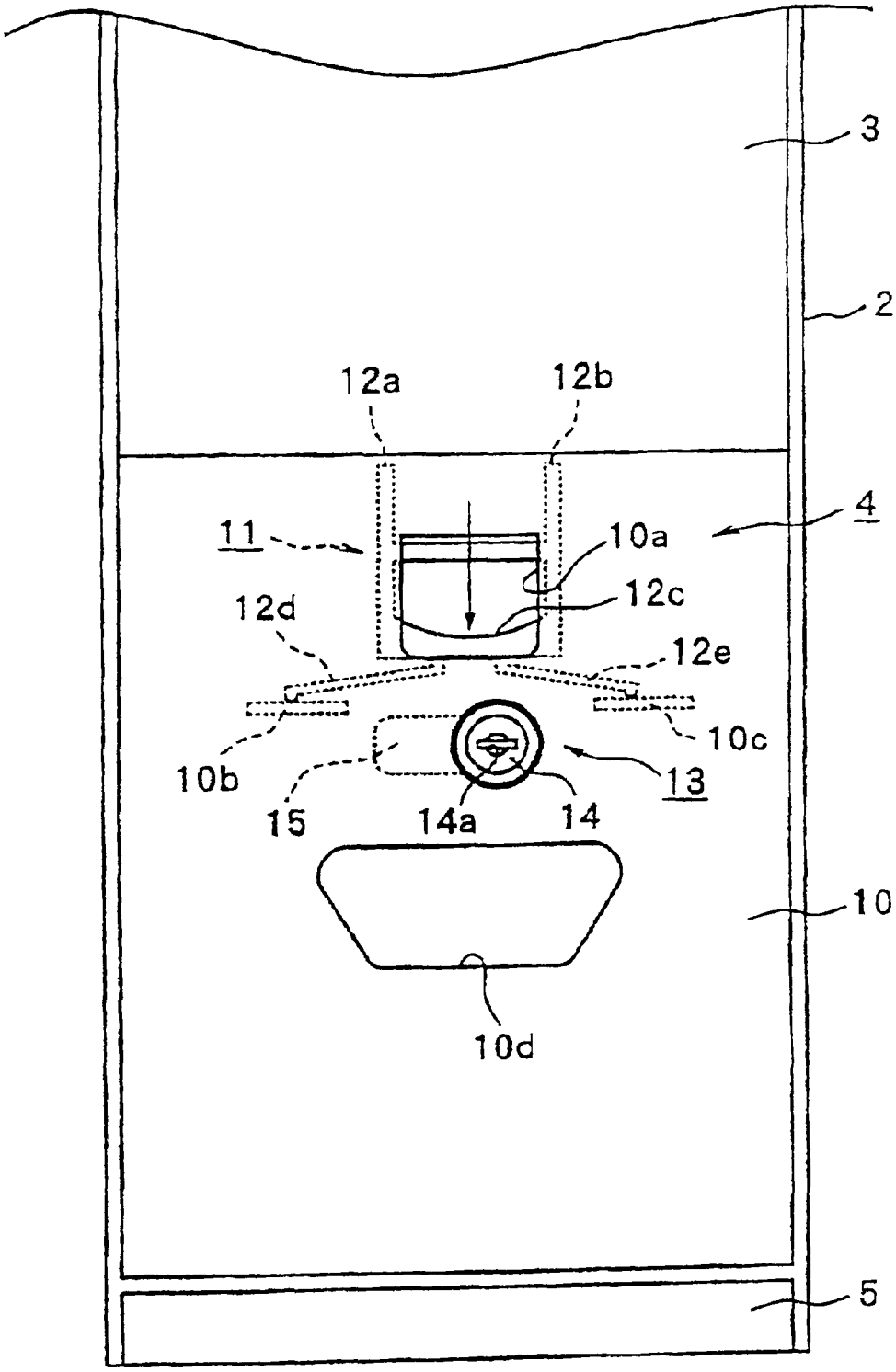
FIG. 5 is an enlarged front view of main parts showing operation of the coin treating device according to the first embodiment.

In the state shown in FIG. 4, if the operator places his/her thumb against the finger grip 12*c* via the operator operation hole 10*a* and inserts other fingers into the finger grip recess 10*d*, and then squeezes strongly with this hand, then as shown in FIG. 5, the finger grip 12*c* of the latch lever 11 will move downwards as shown by the arrow against the spring force of the pair of elastic tongue pieces 12*d* and 12*e*, and hence the pair of projections 12*a* and 12*b* of the latch lever 11 will become disengaged from the coin sorting unit 3 and the latching will be released.

Figure 6:
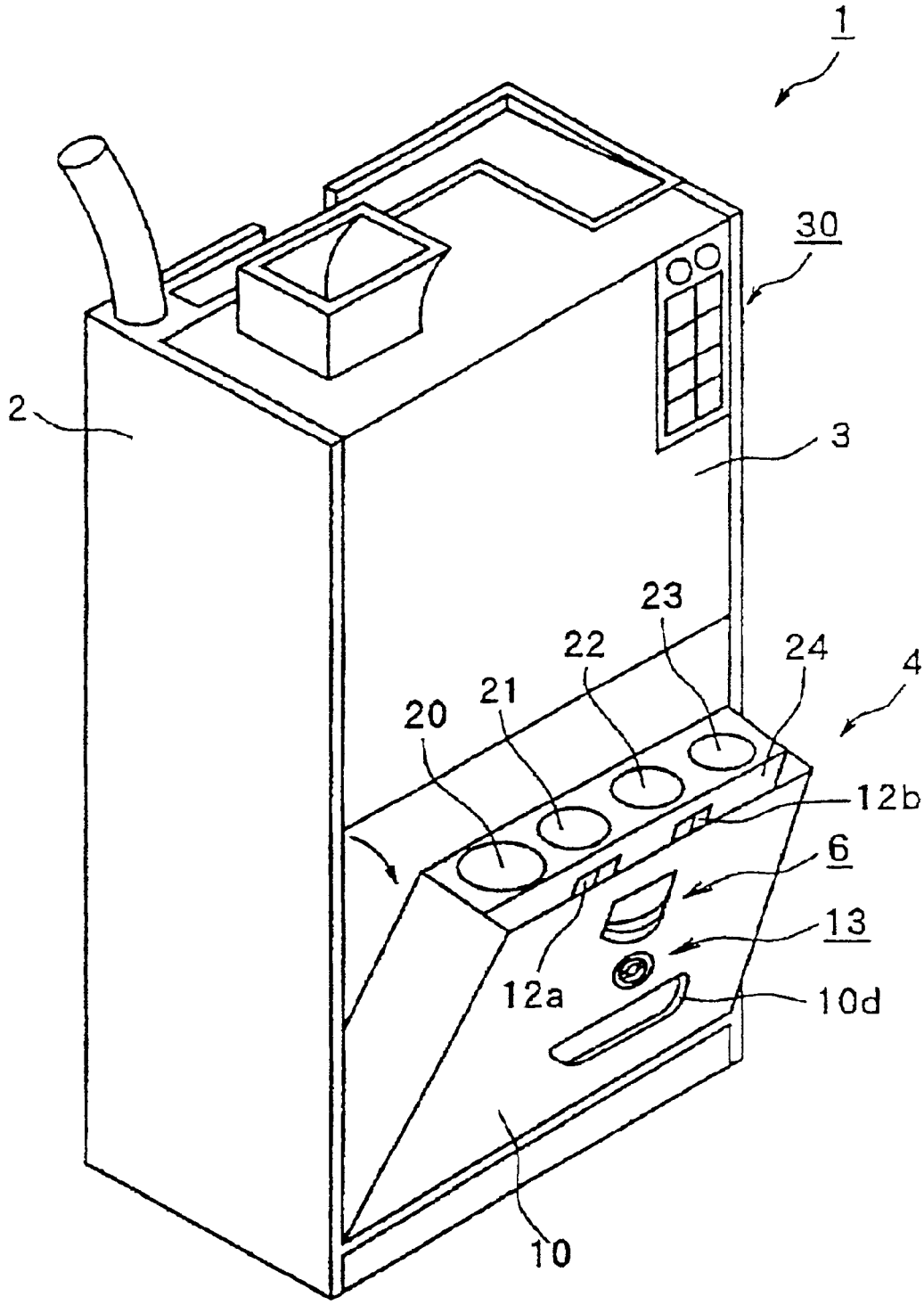
FIG. 6 is a schematic perspective view showing operation of the coin treating device according to the first embodiment.

With his/her thumb still against the finger grip 12*c* via the operator operation hole 10*a* and his/her other fingers still inserted into the finger grip recess 10*d*, when the operator pulls the coin storage unit 4 out forwards, then as shown in FIG. 6, the coin storage unit 4 can be removed from the device main body 2. In this state, maintenance/inspection work such as replenishing change can be carried out.

Note that in FIG. 6, reference numerals 20, 21, 22 and 23 indicate the coin tubes formed in the coin storage unit 4, and reference numeral 24 indicates the rear panel provided behind the front panel 10. The latch lever 11 is provided between the front panel 10 and the rear panel 24.

As shown in FIG. 6, to install the coin storage unit 4 in the device main body 2 after the maintenance/inspection work such as replenishing of change has been carried out, an operation that is the reverse of the operation described above should be carried out.

Specifically, latching is first carried out between the coin storage unit 4 and the coin sorting unit 3 using the latch means 6, and then the key 16 is inserted into the keyhole 14*a* of the key cylinder type locking means 13 shown in FIG. 3 and is rotated in a clockwise direction, so that, as shown in FIG. 2, the stopper piece 15 of the key cylinder type locking means 13 and the finger grip 12*c* of the latch lever 11 will contact one another, thereby stopping the downward movement of the latch lever 11. If the key is then pulled out in this state, it will no longer be possible to release the latching of the latch lever 11 and remove the coin storage unit 4 unless operation is carried out with the key.

It should be noted that in the embodiment described above, the constitution was made to be such that the coin storage unit 4 is latched into the device main body 2 via the coin sorting unit 3 using the latch lever 11 of the latch means 6. However, the present invention is not limited to the embodiment described above. Alternatively, it is also possible to make the constitution such that the latch lever 11 of the latch means 6 is provided in a position facing a side of the device main body 2, and latching is carried out directly between the device main body 2 and the coin storage unit 4.

As described above, with the coin treating device of the present invention, a coin storage unit that is installed detachably in a device main body via latch means has provided therein key cylinder type locking means that restricts the release of the latch of the latch means, and hence so long as the latching by the latch means is released using a key, the coin storage unit cannot easily be removed from the device main body. Therefore, even if the coin treating device is exposed to the outside during maintenance/inspection work of a vending machine, a money changer, a service apparatus or the like as mentioned above, there will be no risk that somebody could easily release the latching of the latch means and take the coin storage unit away from the device main body. Thus, crime prevention effects such as prevention of stealing of coins can be further improved.

Moreover, as shown in FIG. 1, to carry out forcible collection of coins stored in the coin storage unit 4, i.e. inventory processing, inventory means 30 for paying out coins from the coin tubes 20, 21, 22 and 23 (FIG. 6) is provided in the coin sorting unit 3 of the coin treating device 1.

This inventory means 30 comprises various types of switch such as a plurality of inventory switches 31, 32, 33, 34, 35 and 36 for paying out coins independently from each of the coin tubes 20, 21, 22 and 23 (FIG. 6) and supplementary tubes or the like not shown in the drawings, a changeover switch 37, and an automatic change adjusting switch 38 for carrying out automatic adjustment of the number of coins stored in each of the coin tubes, along with pilot lamps 40 and the like.

Figure 7:
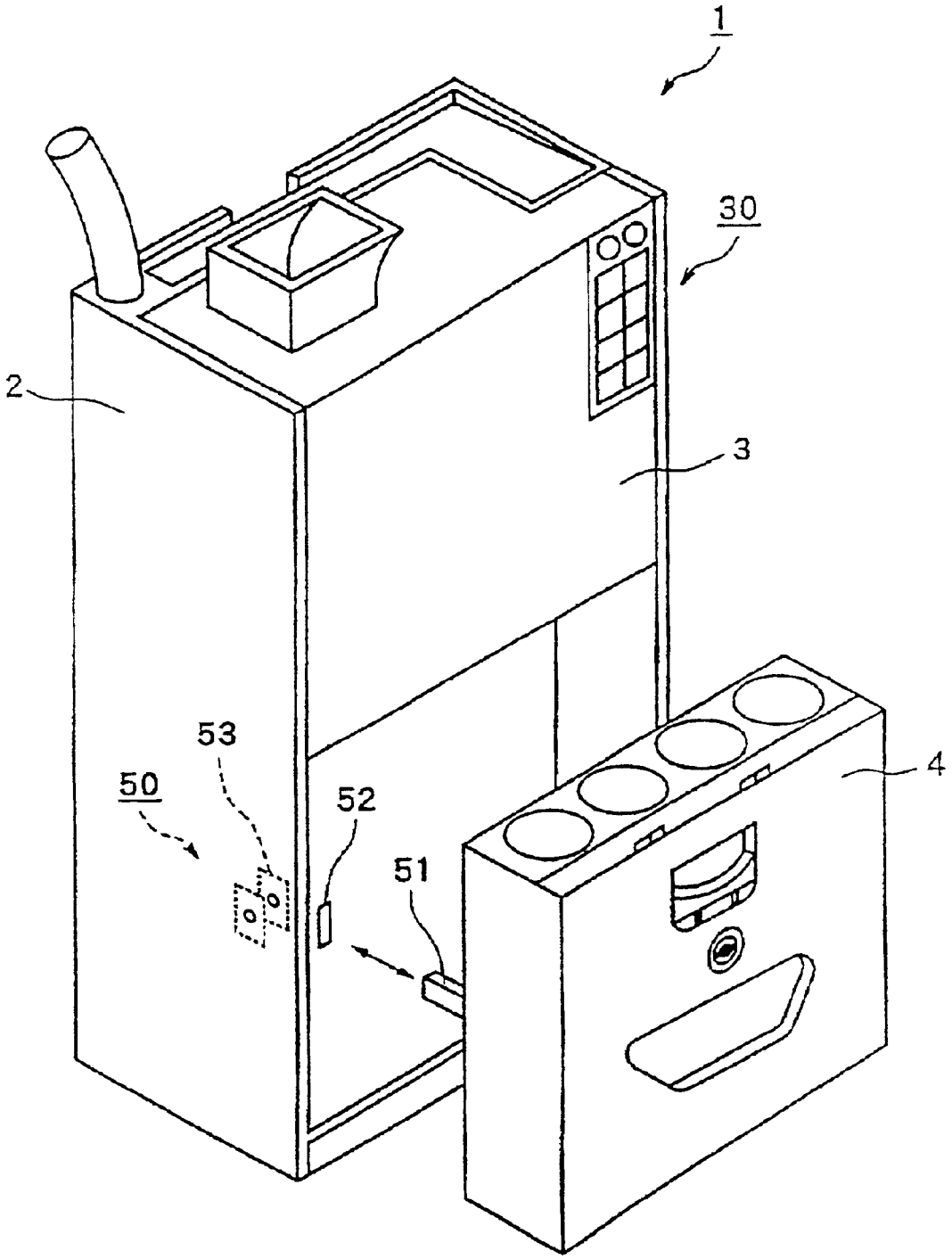
FIG. 7 is a schematic perspective view showing a state in which the coin storage unit has been removed.

Moreover, as shown in the schematic perspective view of FIG. 7, which shows a state in which the coin storage unit 4 has been removed from the device main body 2, the device main body 2 has provided therein a cassette switch 50 that detects whether the coin storage unit 4 is installed or detached and the type of the coin storage unit 4 and the like. This cassette switch 50 comprises a projection 51 that is provided projecting out from a rear face of the coin storage unit 4 and a photo-interrupter 53 that is provided inside the device main body 2. When the projection 51 of the coin storage unit 4 is inserted into the device main body 2 via a hole 52, the presence thereof is detected by the photo-interrupter 53.

Figure 8:
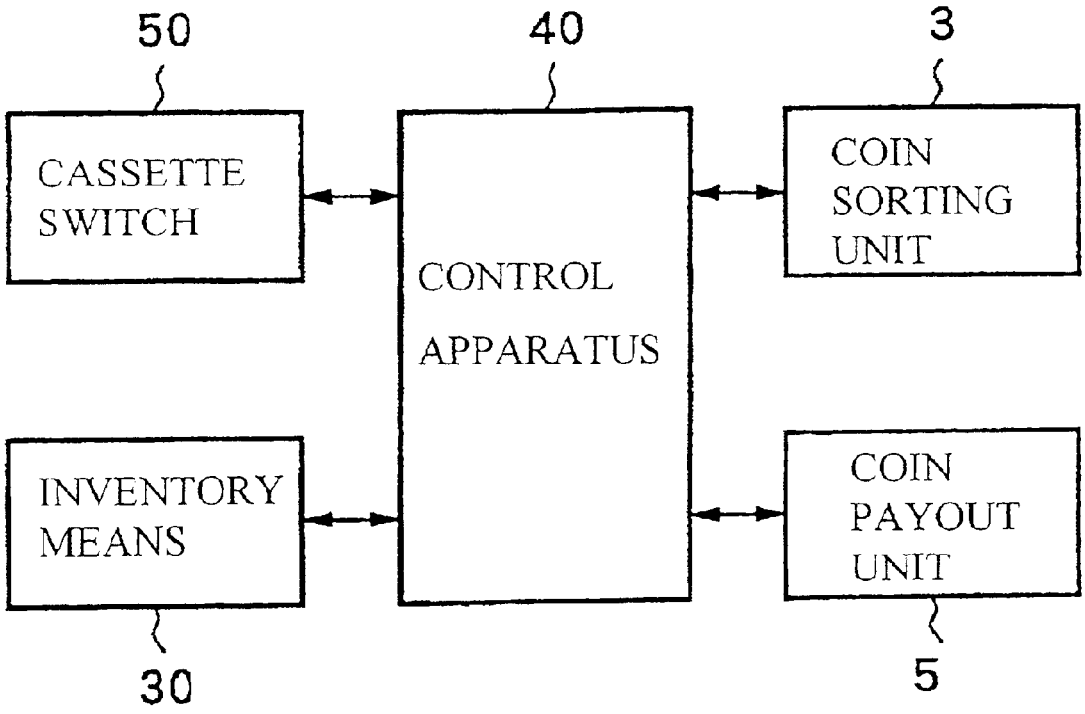
FIG. 8 is a block diagram of a control apparatus according to a second embodiment.

Further, as shown in the block diagram of FIG. 8, the coin treating device 1 has provided therein a control apparatus 40 for controlling the driving of the coin treating device 1.

This control apparatus 40 drives the coin sorting unit 3 shown in FIG. 1, carrying out coin processing such as sorting inserted coins into genuine and counterfeit coins and sorting the genuine coins by denomination, and also drives the coin payout unit 5 in the case that there is change, carrying out coin payout processing of paying out change from the coin storage unit 4.

Moreover, the control apparatus 40 detects ON and OFF signals from the cassette switch 50 shown in FIG. 7, and based on the ON and OFF signals from the cassette switch 50, it sets forbiddance or forbiddance release of inventory process by means of the inventory means 30.

Figure 9:
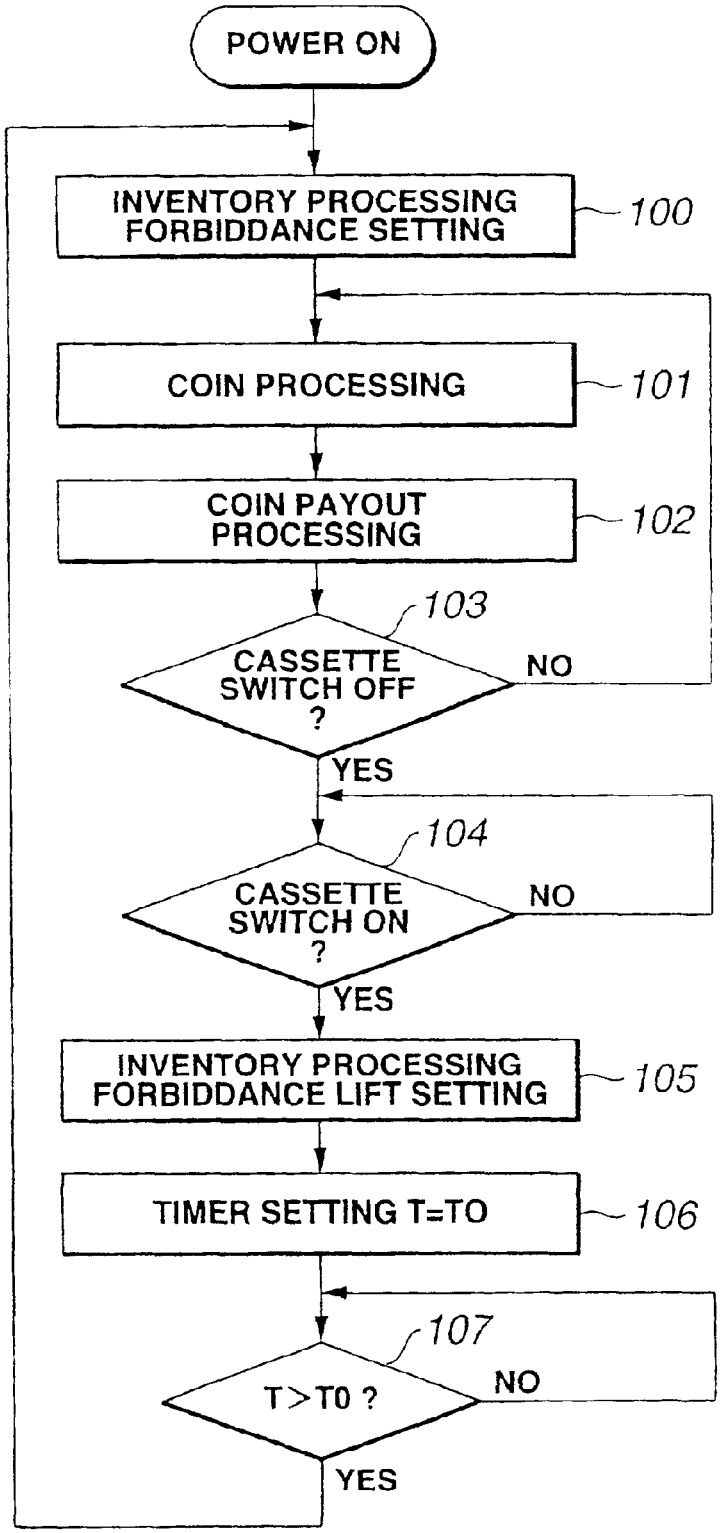
FIG. 9 is a flowchart showing operation of the control apparatus according to the second embodiment.

The operation of the control apparatus 40 is described now referring to the flowchart of FIG. 9.

When the power is turned on, the control apparatus 40 carries out inventory processing forbiddance setting for the inventory means 30 (step 100).

With the coin treating device 1, inventory processing forbiddance for the inventory means 30 is normally set by the control apparatus 40 at normal times. Therefore, even if the switch 31, 32, 33, 34, 35, 36, 37 or 38 (FIG. 1) of the inventory means 30 is pressed, inventory processing cannot be carried out.

After the control apparatus 40 has carried out the inventory processing forbiddance setting by the inventory means 30 in step 100 in the above manner, the control apparatus 40 drives the coin sorting unit 3, and carries out coin processing such as sorting inserted coins into genuine and counterfeit coins and sorting the genuine coins by denomination (step 101).

Further, after the coin processing has been carried out, if change is to be paid out, the control apparatus 40 drives the coin payout unit 5, and carries out coin payout processing of paying out change from the coin storage unit 4 (step 102).

Once this coin processing and coin payout processing have been completed, the control apparatus 40 determines whether or not the cassette switch 50 shown in FIG. 7 has turned OFF, i.e. whether or not the coin storage unit 4 has been removed from the device main body 2 (step 103).

In the case that the control apparatus 40 determines that the cassette switch 50 is not OFF, i.e. that the coin storage unit 4 is still installed in the device main body 2, the processing from step 101 to step 103 described above is repeated.

On the other hand, in the case that the control apparatus 40 determines in step 103 that the cassette switch 50 is OFF, i.e. that the coin storage unit 4 has been removed from the device main body 2, the control apparatus 40 determines whether or not the cassette switch 50 is ON, i.e. whether or not the coin storage unit 4 has been installed in the device main body 2 (step 104).

That is, the control apparatus 40 determines whether or not the coin storage unit 4 has been temporarily removed from the device main body 2 in step 103, and whether or not the removed coin storage unit 4 has been reinstalled in the device main body 2 in step 104; in the case that it is determined that the coin storage unit 4 has been reinstalled in the device main body 2 (step 104), inventory processing forbiddance lifting for the inventory means 30 is set (step 105).

Note that when the control apparatus 40 sets the inventory processing forbiddance lifting for the inventory means 30 in step 105, at the same time the pilot lamp 40 (FIG. 1) of the inventory means 30 may be made to flicker, to display that the inventory processing forbiddance lifting has been set. It goes without saying that the flickering of the pilot lamp 40 is stopped when inventory processing forbiddance is set.

Next, the control apparatus 40 sets a timer to T=T0, thus setting the time period for which inventory processing forbiddance lifting is possible (step 106).

In this way, the control apparatus 40 sets inventory processing forbiddance lifting in step 105, and next sets the timer to T=T0 in step 106, whereupon inventory processing forbiddance lifting is set for a prescribed time period, i.e. T0. During this time period, by pressing the switch 31, 32, 33, 34, 35, 36, 37 or 38 (FIG. 1) of the inventory means 30, inventory processing of forcibly paying out coins from the coin storage unit 4 can be carried out.

Next, the control apparatus 40 determines whether or not the time period T0 set the timer has passed (step 107), and if it is determined that the time period T0 has passed, then the control apparatus 40 once again carries out the inventory processing forbiddance setting for the inventory means 30 (step 100), and then the steps described above are repeated.

That is, according to the control apparatus 40 described above, inventory processing forbiddance is set at normal times, and hence with for example a vending machine, a money changer, a service apparatus or the like in which is installed a coin treating device 1 having such a control apparatus 40, in the case that the coin treating device 1 is exposed to the outside during maintenance/inspection work, even if somebody operates the switch 31, 32, 33, 34, 35, 36, 37 or 38 of the inventory means 30, the inventory processing will not be carried out. Therefore, coins will not be paid out and taken away from the coin storage unit 4 without permission.

Moreover, with the control apparatus 40, by detecting the detachment and re-installment of the coin storage unit 4 from the device main body 2 (steps 103, 104), inventory processing forbiddance lifting is set for a time period T0 set using a timer (steps 105, 106), and during this time period if the switch 31, 32, 33, 34, 35, 36, 37 or 38 of the inventory means 30 is operated, then inventory processing can be carried out. However, in the present embodiment in particular, the operation of removing the coin storage unit 4 from the device main body 2, which is a precondition for carrying out the setting of inventory processing forbiddance lifting (step 103), is controlled by the key cylinder type locking means 13 which restricts the release of the latch of the latch means 6 as shown in FIG. 3, and hence only a cash manager having a key 16 can detach and re-install the coin storage unit 4 and carry out inventory processing, and other people cannot carry out inventory processing.

Consequently, with the coin treating device described above, because the coin treating device has a control apparatus that forbids inventory processing using the inventory means at normal times, but permits inventory processing using the inventory means when the coin storage unit is detached and then re-installed, inventory processing cannot be carried out unless a specified operation is carried out, and hence the risk that, during maintenance/inspection work of a vending machine, a money changer, a service apparatus or the like, the inventory switches of the inventory means might be operated by somebody at will, resulting in inventory processing being carried out and coins being taken away from the coin storage unit without permission, can be reduced as much as possible.

Further, the operation of detaching from and re-installing in the device main body, which is a precondition for allowing inventory processing, is controlled by the key cylinder type locking means which restricts release of the latch of the latch means. Therefore, only a cash manager having a key can detach the coin storage unit and carry out inventory processing, and hence crime prevention effects such as prevention of stealing of coins can be further improved.

In the above embodiment, the constitution was made to be such that inventory processing using the inventory means is forbidden at normal times, but inventory processing using the inventory means is permitted when the coin storage unit has been detached and re-installed. However, the present invention is not limited to the above embodiment. Alternatively, it is also possible to carry out the forbiddance of inventory processing and the lifting thereof based on the detachment and re-installment of the coin storage unit and specified operation of the inventory means.

Figure 10:
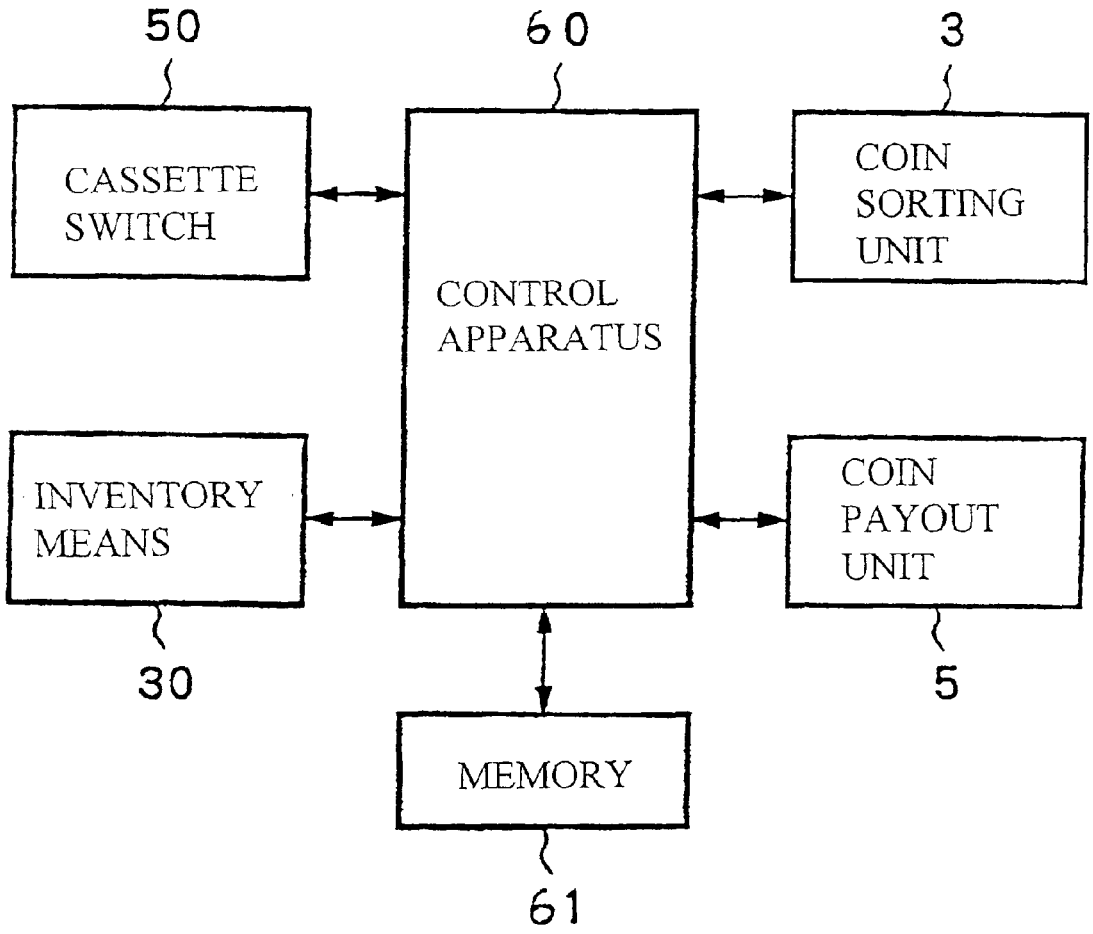
FIG. 10 is a block diagram of a control apparatus according to a third embodiment.

FIG. 10 is a block diagram of a control apparatus 60 that carries out the forbiddance of inventory processing and the lifting thereof based on detachment and re-installment of the coin storage unit and specified operation of the inventory means as mentioned above.

The control apparatus 60 drives the coin sorting unit 3 shown in FIG. 1, carrying out coin processing such as sorting inserted coins into genuine and counterfeit coins and sorting the genuine coins by denomination, and also drives the coin payout unit 5 in the case that there is change to be paid out, carrying out coin payout processing of paying out change from the coin storage unit 4.

Also, the control apparatus 60 reads out information relating to inventory processing stored in advance in a memory unit 61, and detects ON and OFF signals from the cassette switch 50 shown in FIG. 7. The control apparatus 60 then carries out inventory forbiddance setting or inventory forbiddance lifting setting for the inventory means 30 based on the ON and OFF signals from the cassette switch 50, and based on a predetermined specified operation of the various types of switch that make up the inventory means 30, for example the inventory switches 31, 32, 33, 34, 35 and 36, the changeover switch 37, and the automatic change adjusting switch 38, i.e. a specified switch operation.

Note that the memory unit 61 comprises a memory for which contents written therein can be erased and changed any number of times.

Figure 11:
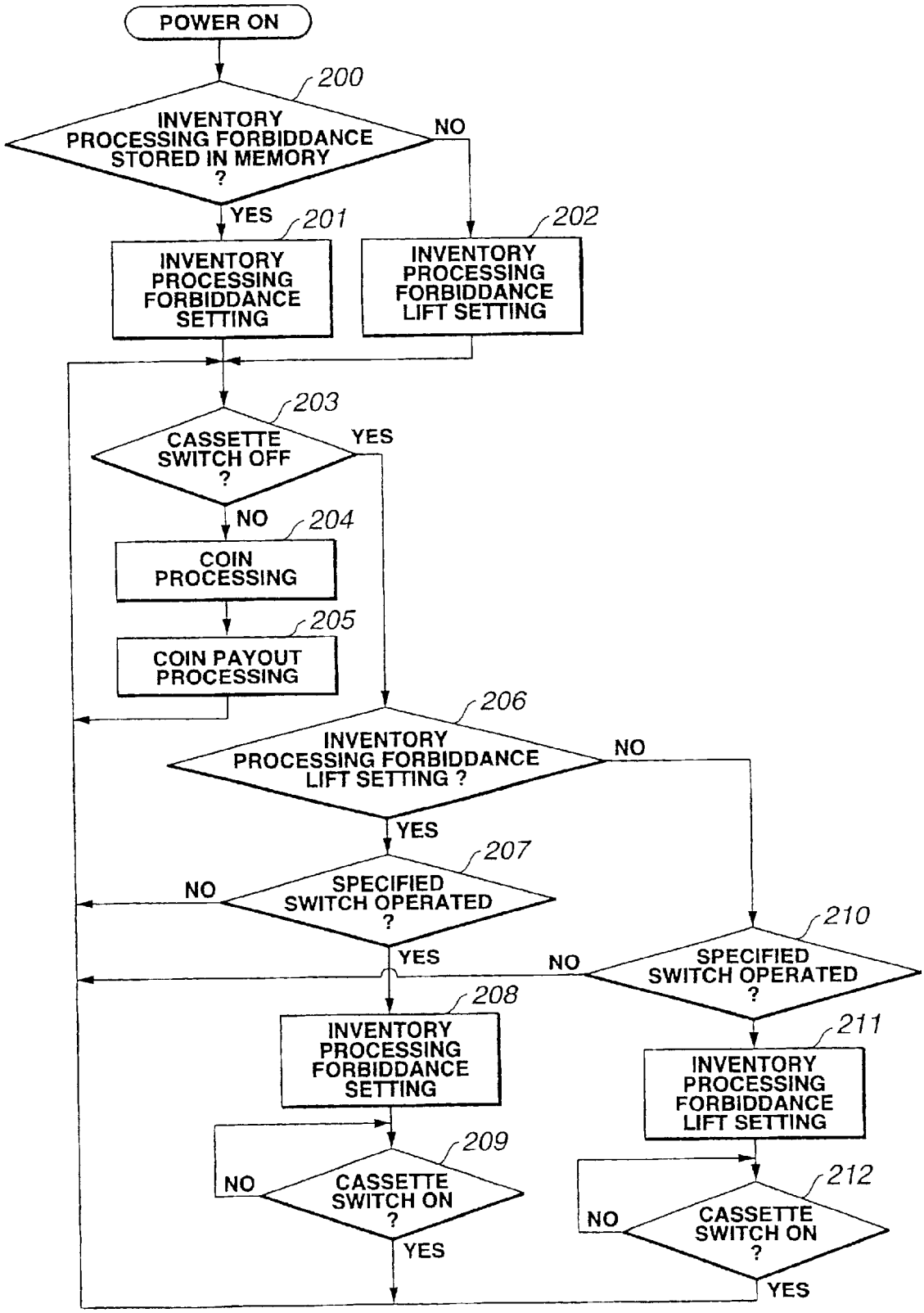
FIG. 11 is a flowchart showing operation of the control apparatus according to the third embodiment.

Next, the operation of the control apparatus 60 is described referring to the flowchart of FIG. 11.

When the power is turned on, the control apparatus 60 reads out the information relating to inventory processing that was stored in advance in the memory unit 61 (step 200), and in the case that this information is inventory forbiddance information, it carries out inventory processing forbiddance setting based on this information (step 201). Note that in the case that the control apparatus 60 carries out inventory processing forbiddance setting in step 201, this information, i.e. inventory forbiddance information is written into the memory unit 61.

On the other hand, if in step 200 the control apparatus 60 determines that the information relating to inventory processing stored in the memory unit 61 is not inventory forbiddance information, then the control apparatus 60 carries out inventory processing forbiddance lifting setting based on this information (step 202). Note that in the case that the control apparatus 60 carries out inventory processing forbiddance lifting setting in step 202, this information, i.e. inventory forbiddance lifting information is written into the memory unit 61.

That is, according to the control apparatus 60 described above, if inventory processing forbiddance setting is carried out in step 201, then it becomes that inventory processing of the various coins cannot be carried out even if the switch 31, 32, 33, 34, 35, 36, 37 or 38 (FIG. 1) of the inventory means 30 is pressed. Moreover, if inventory processing forbiddance lifting setting is carried out in step 202, then it becomes that inventory processing of the various coins can be carried out by pressing the switch 31, 32, 33, 34, 35, 36, 37 or 38 (FIG. 1) of the inventory means 30.

Next, the control apparatus 60 determines whether or not the cassette switch 50 shown in FIG. 7 has turned OFF, i.e. whether or not the coin storage unit 4 has been removed from the device main body 2 (step 203).

In the case that the control apparatus 60 determines that the cassette switch 50 is not OFF, i.e. that the coin storage unit 4 is still installed in the device main body 2, the control apparatus 60 drives the coin sorting unit 3, and carries out coin processing such as sorting inserted coins into genuine and counterfeit coins and sorting the genuine coins by denomination (step 204).

Moreover, after such coin processing has been carried out, in the case that there is change to be paid out, the control apparatus 60 drives the coin payout unit 5, and carries out coin payout processing of paying out change from the coin storage unit 4 (step 205).

After that, the processing from step 203 onwards described above is repeated.

On the other hand, in the case that the control apparatus 60 determines in step 203 that the cassette switch 50 is OFF, i.e. that the coin storage unit 4 has been removed from the device main body 2, next the control apparatus 60 determines whether or not inventory processing is possible at present, i.e. whether or not inventory processing forbiddance lifting setting has been carried out (step 206).

In the case that the control apparatus 60 determines in step 206 that at present inventory processing forbiddance lifting setting has been carried out, next the control apparatus 60 determines whether or not the predetermined specified switch operation of the switches 31, 32, 33, 34, 35, 36, 37, 38 that constitute the inventory means 30 has been carried out (step 207).

Note that this specified switch operation means a preset switch operation such as, for example, pressing the changeover switch 37 (FIG. 1) for a certain time period (for example 5 seconds).

Note, however, that instead of pressing the changeover switch 37 (FIG. 1) for a certain time period (for example 5 seconds), it is also possible to preset an operation such as pressing the switch 31 and the switch 32 simultaneously as the specified switch operation.

In this way, in the case that the control apparatus 60 determines that inventory processing forbiddance lifting setting has been currently carried out in step 206, and that the specified switch operation has been carried out in step 207, then in step 208 the control apparatus 60 carries out inventory processing forbiddance setting.

The control apparatus 60 then determines whether or not the cassette switch 50 is ON, i.e. whether or not the coin storage unit 4 has been reinstalled in the device main body 2, in step 209, and in the case that it is determined that the coin storage unit 4 has been reinstalled in the device main body 2, the processing from step 203 onwards is repeated.

That is, in the case that the control apparatus 60 determines that the coin storage unit 4 has been temporarily removed from the device main body 2 in step 203, and then that inventory processing forbiddance lifting setting has been currently carried out in step 206, then inventory means 30 inventory processing forbiddance is set (208) based on specified switch operation of switches constituting the inventory means 30 in step 207. In the case that it is then determined in step 209 that the coin storage unit 4 has been reinstalled in the device main body 2, then coin processing and coin payout processing are subsequently carried out with inventory processing forbiddance still set.

According to the control apparatus 60 described above, after the processing from step 206 to step 209 has been carried out, inventory processing forbiddance remains set. Therefore, even if, for example, in this state in which inventory processing forbiddance is set, the coin treating device 1 is exposed to the outside during maintenance/inspection work of a vending machine, a money changer, a service apparatus or the like in which the coin treating device 1 is installed, and at this time somebody operates the switch 31, 32, 33, 34, 35, 36, 37 or 38 of the inventory means 30, inventory processing will not be carried out, and hence coins will not be paid out from the coin storage unit 4 without permission and taken away.

Note that, with the control apparatus 60, when the inventory processing forbiddance for the inventory means 30 is set in step 208, the pilot lamp 40 (FIG. 1) of the inventory means 30 may be made to flicker at the same time, thereby to display that inventory processing forbiddance has been set. It goes without saying that the flickering of the pilot lamp 40 is stopped when inventory processing forbiddance lifting is set.

Alternatively, as a display method to distinguish between the state in which inventory processing forbiddance has been set and the state in which inventory processing forbiddance lifting has been set, it is also possible to display the distinction by for example simply lighting the pilot lamp 40 at normal times and then turning off the pilot lamp 40 instead of making the pilot lamp 40 flicker and stopping this flickering as described above. Thus, there is of course no limitation to the above display method.

Note that in the case that the specified switch operation has not been carried out in step 207, the processing from step 203 onwards is repeated.

Further, as described above, to move from a state in which inventory processing forbiddance is set to a state in which inventory processing is possible, the cassette switch 50 is turned OFF by again removing the coin storage unit 4 from the device main body 2, as shown in step 203.

As a result, in step 206 it is determined whether or not inventory processing forbiddance lifting setting has been currently carried out. Because inventory processing forbiddance is currently set as described above, the result of determination is NO, and hence operation is proceeded to step 210.

In step 210, if the same specified switch operation as described above, i.e. the predetermined specified switch operation of the switches 31, 32, 33, 34, 35, 36, 37, 38 and so on that make up the inventory means 30, is carried out, then in step 211 inventory processing forbiddance lifting setting is carried out.

Then in step 212, if the coin storage unit 4 is reinstalled in the device main body 2 (cassette switch ON), then the processing from step 203 onwards is repeated with inventory processing forbiddance lifting still set, i.e. in a state in which inventory processing is possible.

Inventory processing should thus be carried out at this time.

To return again to the inventory processing forbiddance setting, the coin storage unit 4 is removed from the device main body 2, and then the processing from step 206 to step 209 is carried out.

According to the control apparatus 60 described above, the constitution was made to be such that after it has been detected that the coin storage unit 4 has been removed from the device main body 2 (step 203), the specified switch operation of the inventory means 30 (step 207 or 210) is carried out to select either inventory processing forbiddance setting or inventory processing forbiddance lifting setting. In the present embodiment, since the operation of removing the coin storage unit 4 from the device main body 2 (step 203), which is a precondition for carrying out the inventory processing forbiddance lifting setting (step 211), is controlled by the key cylinder type locking means 13 which restricts the release of the latch of the latch means 6 as shown in FIG. 3, once inventory processing forbiddance setting has been carried out, a person not having a key 16 cannot remove the coin storage unit 4 so as to carry out inventory processing forbiddance lifting setting (step 211). Thus, only a cash manager having a key 16 can carry out inventory processing by detaching and then re-installing the coin storage unit 4. Thus, other people cannot carry out inventory processing.

Note that, with the control apparatus 60 in the embodiment described above, the constitution was made to be such that in step 206 the current state of setting for inventory processing, i.e. whether the current state is inventory processing forbiddance setting or inventory processing forbiddance lifting setting, is determined, and then in step 207 or step 210 inventory processing forbiddance setting or inventory processing forbiddance lifting setting is carried out using the same specified switch operation. However, the present invention is not limited to the above embodiment, but rather it is also possible to make the constitution such that the specified switch operations in step 207 and step 210 are not the same switch operation, but instead determination is carried out using a different switch operation in each case.

For example, the specified switch operation in step 207 may be made to be the operation of simultaneously pressing the switches 31 and 32 out of the switches 31, 32, 33, 34, 35, 36, 37 and 38 that make up the inventory means 30 shown in FIG. 1, and the specified switch operation in step 210 may be made to be the operation of simultaneously pressing the switches 33 and 35 out of the switches 31, 32, 33, 34, 35, 36, 37 and 38 that make up the inventory means 30 shown in FIG. 1.

As described above, the coin treating device has a control apparatus that carries out forbiddance of inventory processing and lifting thereof based on detachment and re-installment of the coin storage unit and on specified operation of the inventory means. Therefore, so long as the specified operation using the inventory means is not carried out, it is not possible to carry out the lifting of the forbiddance of inventory processing. Thus, once inventory processing has been forbidden, the risk that the inventory switches of the inventory means might be operated by somebody at will during maintenance/inspection work of a vending machine, a money changer, a service apparatus or the like, resulting in inventory processing being carried out and coins being taken away from the coin storage unit without permission, can be reduced as much as possible.

Moreover, the operation of detaching and re-installing the coin storage unit, which is a precondition for carrying out the lifting of the forbiddance of inventory processing, is controlled by the key cylinder type locking means which restricts the release of the latch of the latch means, and hence a person not having a key cannot remove the coin storage unit, and thus only a cash manager having a key can carry out inventory processing by detaching and then re-installing the coin storage unit, and hence crime prevention effects such as prevention of stealing of coins can be further improved.

INDUSTRIAL APPLICABILITY

As described above, the present invention is suitable for a coin treating device for which stealing of coins from a coin storage unit is prevented as much as possible.

What is claimed is:

1. A coin treating device including inventory means that carries out inventory processing of forcibly paying out coins from a coin storage unit, characterized in that a control apparatus is provided that forbids the inventory processing by the inventory means at normal times, and permits the inventory processing by the inventory means when the coin storage unit is detached and then re-installed.

2. The coin treating device according to claim 1, characterized in that the inventory means comprises a plurality of inventory switches.

3. The coin treating device according to claim 1, characterized in that the coin storage unit is installed detachably via latch means, and key cylinder type locking means that restricts release of latching by the latch means is provided in the coin storage unit.

4. The coin treating device according to claim 1, characterized in that the latch means has a latch lever movable for latching and releasing the latching, and the key cylinder type locking means has a stopper piece that turns by key operation and stops movement of the latch lever by causing the stopper piece to abut against the latch lever, thereby restricting release of latching by the latch means.

5. A coin treating device including inventory means that carries out inventory processing of forcibly paying out coins from a coin storage unit, characterized in that a control apparatus is provided that forbids and lifts forbiddance of the inventory processing based on detachment and re-installment of the coin storage unit together with specified operation by the inventory means.

6. The coin treating device according to claim 5, characterized in that the inventory means comprises a plurality of inventory switches.

7. The coin treating device according to claim 5, characterized in that the coin storage unit is installed detachably via latch means, and key cylinder type locking means that restricts release of latching by the latch means is provided in the coin storage unit.

8. The coin treating device according to claim 5, characterized in that the latch means has a latch lever movable for latching and releasing the latching, and the key cylinder type locking means has a stopper piece that turns by key operation and stops movement of the latch lever by causing the stopper piece to abut against the latch lever, thereby restricting release of latching by the latch means.

* * * * *